US005501314A

United States Patent [19]

Tomat et al.

[11] Patent Number: 5,501,314

[45] Date of Patent: Mar. 26, 1996

[54] METHOD FOR THE MULTIPLE RECEIPT AND DISCHARGE OF ROLLED SECTIONS ONTO A COOLING PLATE AND DEVICE PERFORMING SUCH METHOD

[75] Inventors: Ferruccio Tomat, Udine; Giuseppe Bordignon, Bicinicco, both of Italy

[73] Assignee: Danieli & C. Officine Meccaniche SpA, Buttrio, Italy

[21] Appl. No.: 278,001

[22] Filed: Jul. 20, 1994

[30] Foreign Application Priority Data

Jul. 30, 1993 [IT] Italy ..... UD93A0149

[51] Int. Cl.[6] ..... B65G 47/30

[52] U.S. Cl. ..... 198/418.1; 198/433; 198/451; 414/746.4

[58] Field of Search ..... 198/418.1, 418.2, 198/418.6, 433, 448, 451, 463.3, 468.6, 468.8; 414/745.1, 745.7, 746.4

[56] References Cited

U.S. PATENT DOCUMENTS

| | | | |
|---|---|---|---|
| 2,813,615 | 11/1957 | Klein | 198/433 |
| 4,448,298 | 5/1984 | Matsuo | 198/451 |
| 4,832,177 | 5/1989 | Bollig et al. | 198/451 |

FOREIGN PATENT DOCUMENTS

| | | | |
|---|---|---|---|
| 0077951 | 5/1983 | European Pat. Off. | B21B 43/00 |
| 114791 | 1/1984 | European Pat. Off. . | |
| 159728 | 2/1985 | European Pat. Off. | B21B 43/00 |
| 465625 | 9/1928 | Germany . | |
| 7011686 | 2/1972 | Netherlands . | |
| 2066123 | 12/1979 | United Kingdom . | |
| 2166677 | 11/1984 | United Kingdom . | |
| 2199277 | 11/1987 | United Kingdom . | |

*Primary Examiner*—Joseph E. Valenza

*Attorney, Agent, or Firm*—Antonelli, Terry, Stout & Kraus

[57] ABSTRACT

Method for the multiple receipt and discharge of rolled sections onto a cooling plate, the method being suitable to handle simultaneously groups of two or more rolled sections (11) arriving simultaneously from an intake channel, whereby at least one multigroove equipped channel (10) receives the sections (11) simultaneously and discharges them while another group of sections (11) arrives in separate distinct grooves, such discharge taking place in cooperation with specific acceptance seatings (19) on the cooling plate (18), the cooling plate (18) advancing in each forward movement cycle by a number of acceptance seatings (19) equal to "n" times the pitch ("i") of the cooling plate (18), the number "n" being a function of the number of rolled sections arriving at the same time. Device to receive and discharge a multiple of rolled sections (11) onto the cooling plate (18), the device being suitable to handle groups of a plurality of rolled sections (11) at the same time and including a supporting bar (14) positioned above the cooling plate (18) and determining vertically a first guide groove (12*a*–12*c*) and a second guide groove (12*b*–12*d*) on each side, the guide grooves (12) being defined by panels (15) able to move perpendicularly to the supporting bar (14).

14 Claims, 3 Drawing Sheets

METHOD FOR THE MULTIPLE RECEIPT AND DISCHARGE OF ROLLED SECTIONS ONTO A COOLING PLATE AND DEVICE PERFORMING SUCH METHOD

BACKGROUND OF THE INVENTION

This invention concerns a method for the multiple receipt and discharge of rolled sections onto a cooling plate and also the device performing such method.

The invention is applied to the release step on a system, consisting advantageously of a cooling plate, for the removal of rolled sections arriving from a rolling line.

The rolled sections in this invention are delivered axially into receiving channels and are then discharged therefrom by falling onto the cooling plate in cooperation with the cycle of forward movement of the cooling plate.

The invention is applied advantageously in cooperation with methods for the simultaneous rolling of two or more sections according to the splitting process technique.

The state of the art covers many embodiments of channels to receive a plurality of rolled sections at the same time. These channels cooperate at their upstream ends with switches which steer the arriving sections and deliver them into the relative receiving grooves.

Drum-type channels are known and include a plurality of receiving channels positioned circumferentially like a drum. These drum-type channels entail various drawbacks linked to the possible deflection of the bar passing through, the great installed power, the twists produced in the channels, the complexity of construction and the maintenance involved.

IT-83366 A/90 discloses channels including two or more guide grooves positioned substantially symmetrically in relation to a vertical plane, each groove being provided with movable panels.

These movable panels are located in cooperation with the lower part of the guide grooves of the channel and, by being displaced laterally, free the outlet of the channel and enable the section to fall onto the cooling surface.

The working mechanism of the known receiving and discharge devices, while including channels with a plurality of guide grooves, is not suitable to accept at the same time a plurality of sections arriving from a rolling line working by the splitting process.

The present applicants have set themselves the problem of providing a method to receive and discharge rolled sections onto a cooling plate by using suitably adapted receiving channels which make use of the same working principle as the channels described in the aforesaid IT-83366 A/90 and suitable to cooperate with multisection rolling systems.

The applicants have set themselves in particular the problem of speeding up the cycle of receiving and discharging the sections or rolled bars by providing a method especially suitable for the simultaneous receipt and discharge of a plurality of rolled bars without having to interrupt the feed upstream.

GB-A-2,199,277 is known and, as regards the aspects belonging to the present invention, is like IT 83366 A/90, which teaches the provision of two channels suitable to receive sections of different dimensions at two different moments and to discharge those sections then with one single movement.

This teaching entails the necessity of interrupting the upstream feed when discharge takes place, and also enatils feeding the channels with two different sizes, that is to say, it is unable to collaborate with multi-section lines. Moreover, it cannot deliver sections to two successive desired grooves of the cooling plate.

SUMMARY OF THE INVENTION

The present applicants have investigated, tested and achieved this invention to overcome the shortcomings of the state of the art and to provide further advantages.

According to the invention a stationary channel is provided and is positioned upside down above the discharge system, which is the cooling plate for instance.

The channel is suitable to receive at the same time a plurality of sections, up to four sections for instance, coming from a rolling line according to the splitting process method. The sections have a substantially equal cross-section and reach the channel at the same time.

The channel includes in particular at least a double plurality of guide grooves; each plurality of guide grooves is suitable to accept at the same time a plurality of rolled sections leaving a multisection rolling line.

In the method according to the invention some of the guide grooves are engaged in discharging rolled sections, while other guide grooves are receiving rolled sections, and viceversa.

The channel according to this invention includes a central supporting bar, with which movable panels cooperate in forming guide grooves.

The movable panels are able to be displaced perpendicularly to the central bar so as to free the outlet of the single guide grooves and to enable the sections to fall out.

Each guide groove can be equipped with its own movable panel, or else one movable panel can serve two or more guide grooves.

According to an advantageous form of embodiment of the invention one movable panel serves the guide grooves associated with a first simultaneous receipt of the sections, while another movable panel serves the guide grooves associated with a second simultaneous receipt of the sections.

Switch means are included upstream of the channel and steer laterally and/or vertically the rolled sections arriving from the rolling line towards the respective guide grooves located in the receiving channel.

The channel according to the invention cooperates with a cooling plate which, where the channel is suitable to receive two sections at a time, has to have at least a double pitch and be suitable to accept at least two sections per each cycle of displacement.

According to a variant, again where the channel can receive two sections at a time, the cooling plate is a single pitch plate with a double forward movement per each cycle. In both cases the cooling plate is displaced by two teeth per each cycle of forward movement.

According to a variant at least two channels are included side by side and cooperate with at least one suitable lateral switch and at least one vertical switch.

The employment of two multigroove channels, for instance with four grooves per each channel, enables the receiving and discharging device according to the invention to cooperate with splitting process rolling methods with even three of four sections being rolled at a time.

In this case, while one channel is in the discharging step, the other channel is engaged in the step of receiving bars from the rolling line.

Moreover, a plurality of channels side by side can also be used, when only one or two sections are being rolled at a time, so as to reduce the wear of the channels themselves and to enable their working life to be lengthened and maintenance and replacement work to be therefore delayed.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

A multigroove channel 10 according to the invention is equipped for the simultaneous receipt and discharge of pairs of rolled sections 11 leaving an upstream rolling line carrying out rolling of multiple sections.

Figure 1:
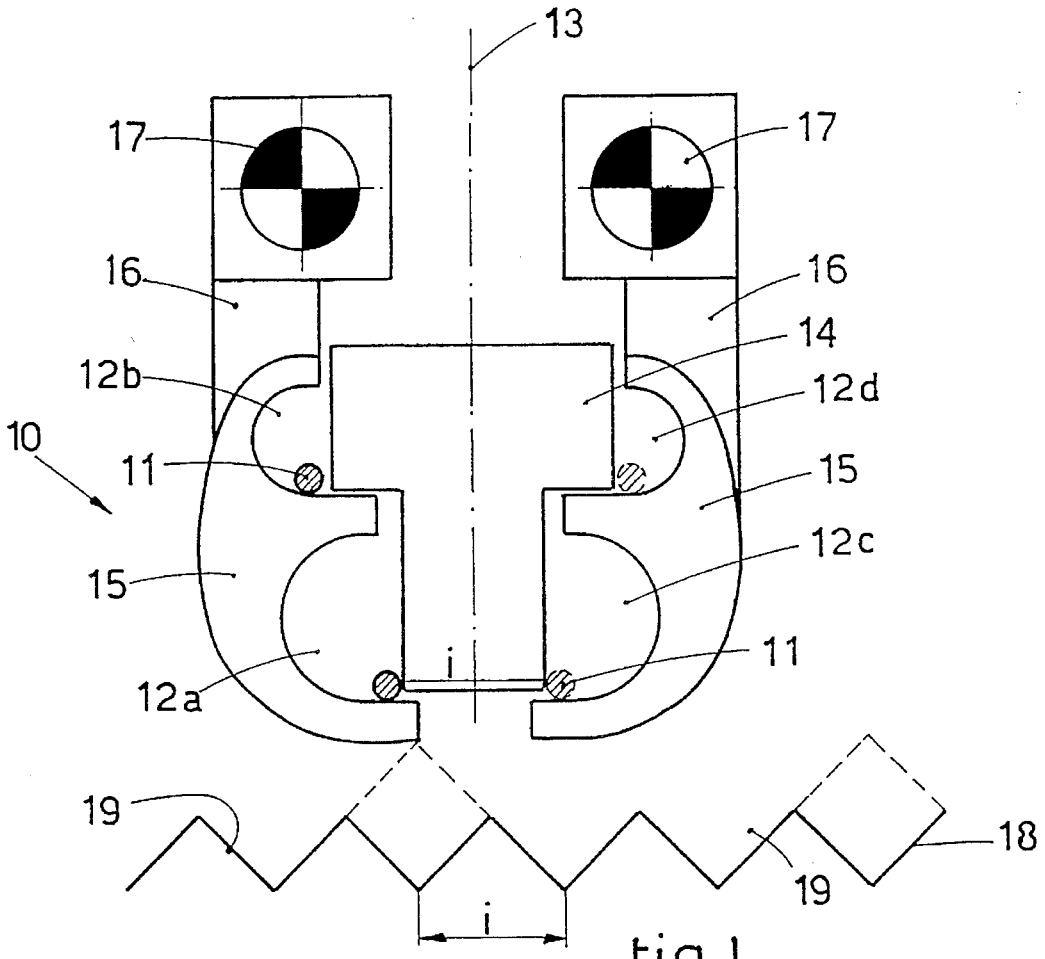
FIG. 1 is a diagram of a receiving channel employed in the method according to the invention.

In the example of FIG. 1 the channel 10 comprises two pairs of guide grooves 12 positioned substantially symmetrically in relation to the vertical median plane 13 of the channel 10.

To be more exact, the vertical plane 13 in this case defines two lefthand guide grooves, namely a lower 12*a* and an upper 12*b* respectively, and two righthand guide grooves, namely a lower 12*c* and an upper 12*d* respectively.

The lefthand 12*a* and righthand 12*c* lower guide grooves are separated by an axial distance "i" equal to one pitch of a cooling plate 18.

The guide grooves 12 are defined by the reciprocal positions of a supporting bar 14, positioned substantially along the direction of arrival of the rolled sections 11, and of a pair of movable panels 15 associated with respective supports 16, each of which is constrained by its respective oscillatory shaft 17.

The differentiated oscillation of the shafts 17 causes oscillation of the respective movable panel 15 so as to make the sections 11 fall onto the underlying cooling plate 18.

Oscillation of the shafts 17 is achieved in a known manner by a motor, which is not shown here but which may be an electric or hydraulic motor, or by a cylinder-piston system, an actuator or another means.

The channel 10 can be equipped with means to brake the sections arriving, those means being of the magnetic type disclosed in IT 83436 A/90 for instance.

The channel 10 may also include positioning means located in a discharge position, such as mechanical end-of-travel abutments, optical or magnetic sensors, for instance, or other means.

The channel 10 as shown is suitable to receive pairs of sections 11 at the same time.

To be more exact, the lay-out of FIG. 1 arranges that two sections 11 leaving the rolling line at the same time are positioned within the lefthand 12*a*–12*b* (or righthand 12*c*–12*d*) guide grooves of the channel 10.

In this example each movable panel 15 cooperates with a pair of guide grooves 12.

The movable panels 15, however, are conformed in such a way as to ensure that one section 11 is discharged at a time, depending on the extent of the oscillation imparted to the relative shaft 17.

To be more exact, a first lateral displacement of a limited extent frees the relative lower guide groove 12*a*–12*c* for discharge of the section 11 located in the lower guide groove, while a further lateral displacement of the movable panel 15 frees the relative upper guide groove 12*b*–12*d* too.

The distance at the lower outlet end of the channel 10 between the sections positioned in the guide grooves 12 on the same horizontal plane is equal to the distance "i" between two adjacent acceptance seatings 19 in the cooling plate 18, whereas the forward movement of the cooling plate 18 in each cycle is equal to "ni", which is advantageously "2i".

This can be achieved either with a cooling plate 18 including two acceptance seatings 19 per each pitch of the plate 18 or with a forward movement of two pitches of the plate 18 in each cycle.

Figure 2:
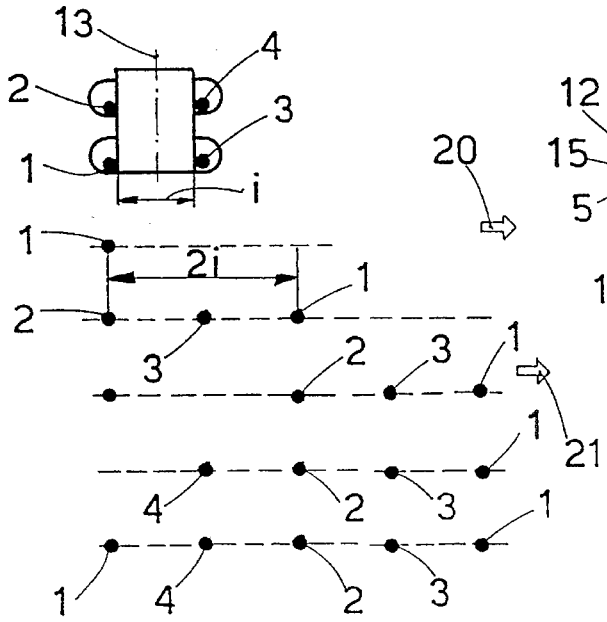
FIG. 2 shows a working cycle of the receiving and discharging method for multisection rolling according to the invention.

The cycle of discharge of the sections 11 is shown in FIG. 2, in which the sections 11 are referenced with the numbers 1, 2, 3 and 4 so as to simplify the description. In particular, the sections referenced with 1 and 2 represent the first pair of sections leaving the rolling line at the same time, whereas the sections referenced with 3 and 4 represent the second pair of sections leaving the rolling line at the same time.

The discharge cycle according to the invention includes the following steps:

- arrival of the sections 1 and 2 in the respective guide grooves 12 of the channel 10;
- opening of the movable panel 15 for discharge of the section 1 onto the cooling plate 18;
- forward movement 20 of the cooling plate 18 by two ("2i") acceptance seatings 19;
- opening of the movable panel 15 for discharge of the section 2 and simultaneous
- arrival of the sections 3 and 4 in the relative guide grooves 12;
- opening of the movable panel 15 for discharge of the section 3 onto the cooling plate 18;
- forward movement 21 of the cooling plate 18 by two ("2i") acceptance seatings 19;
- opening of the movable panel 15 for discharge of the section 4 onto the cooling plate 18 and simultaneous
- arrival of new sections 1 and 2 in the respective guide grooves 12;
- opening of the movable panel 15 for discharge of the section 1 onto the cooling plate 18.

In the method according to the invention each guide groove 12 may have its own movable panel 15, or else movable panels 15 of the type shown in FIG. 1 can be used by regulating the extent of the oscillation according to the section 11 to be discharged.

The channel 10 according to the invention can also be used in cooperation with methods to roll one single section.

Figure 3:
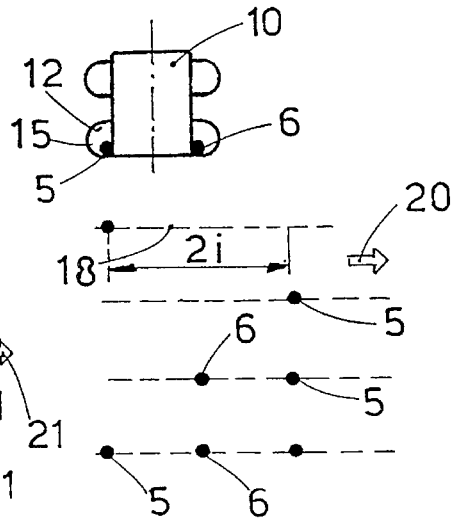
FIG. 3 shows a working cycle of the receiving and discharging method for the rolling of a single section according to the invention.

According to the example of FIG. 3, in which the sections have been referenced with 5 and 6 for descriptive convenience, the receiving and discharging cycle includes:

arrival of the section 5 in the relative guide groove 12;

discharge of the section 5 onto the cooling plate 18;

forward movement 20 of the cooling plate 18 by two pitches ("2i") (or else forward movement by one pitch as the cooling plate 18 is provided with two acceptance seatings 19 per pitch) and simultaneous arrival of the section 6 in the relative guide groove 12;

discharge of the section 6 onto the cooling plate 18 and simultaneous arrival of the new section 5 in the relative guide groove 12;

forward movement of the cooling plate 18 by two pitches ("2i");

discharge of the new section 5 onto the cooling plate 18.

Figure 4:
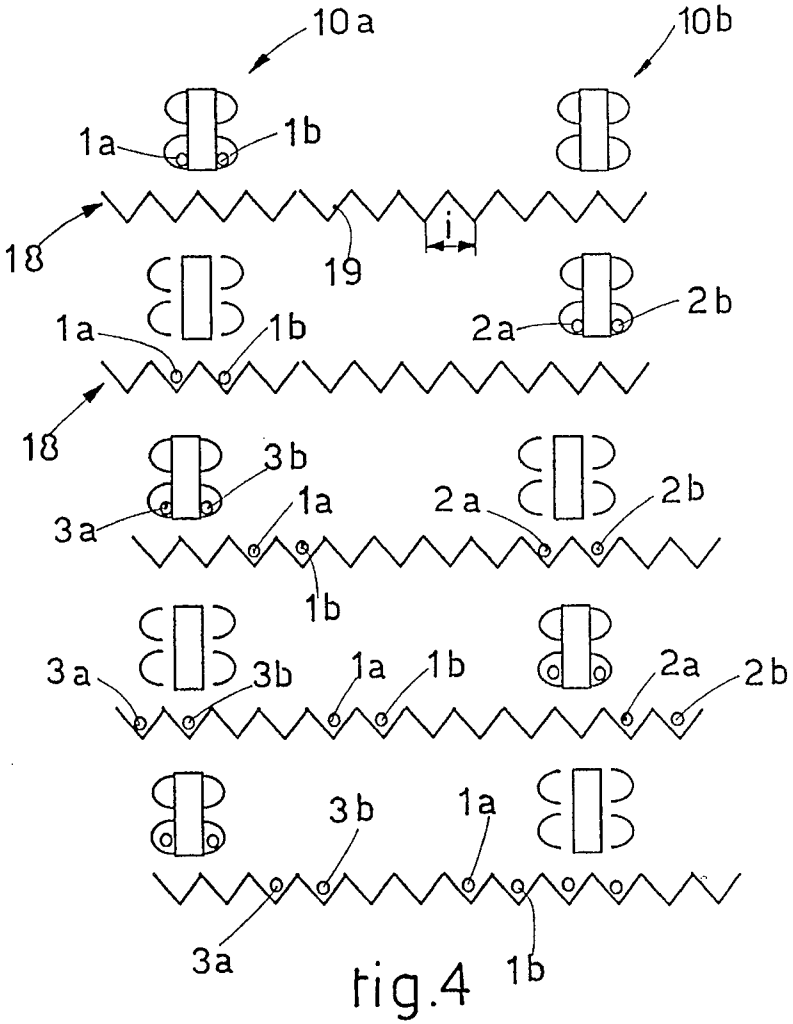
FIGS. 4, 5 and 6 show, according to a variant with two channels side by side, the respective working cycles for the cases of one and two sections, three sections and four sections at a time.
Figure 6:
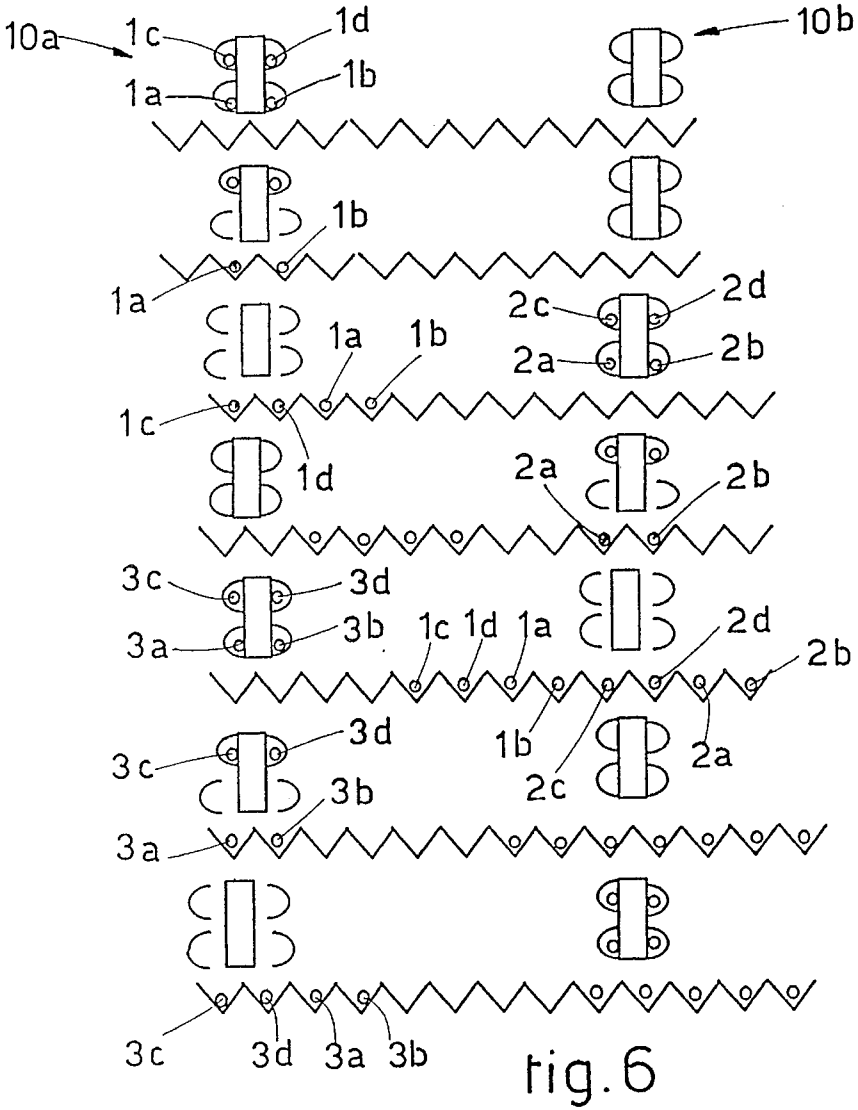
Figure 5:
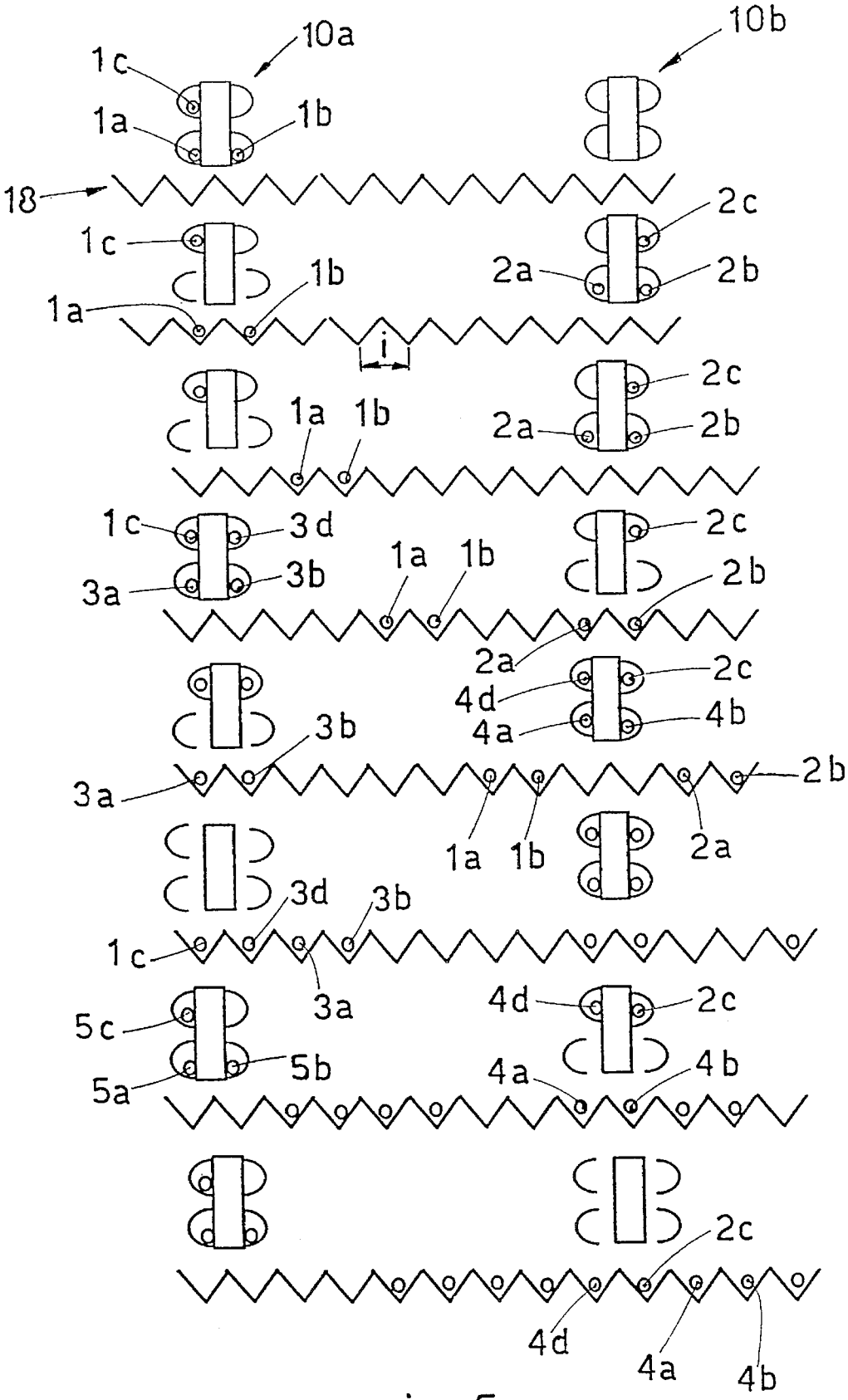

FIGS. 4, 5 and 6 show a further variant of the invention, in which are used two multigroove channels 10, 10*a* and 10*b* respectively, which are substantially positioned side by side and are suitable to cooperate with lateral and vertical switches positioned upstream.

By using two multigroove channels 10, each with four guide grooves 12 in this case, the receiving and discharging method according to the invention can be associated with methods for the rolling of multiple sections with splitting of the multiple sections into three or four sections 11.

In all cases the distance between the two side-by-side channels 10 is equivalent to a number of seatings 19 such as to achieve, with normal working, a complete filling of the seatings 19 of the cooling plate 18.

In other words the sections 11 discharged in a first cycle of discharge of the first channel 10*a* are distanced from the sections 11 of a second cycle of discharge of the same first channel 10*a* by a number of seatings 19 equal to the number of sections 11 discharged per each cycle from the second channel 10*b*.

FIG. 4 shows a cycle that uses two multigroove channels 10 for the rolling of one or two sections 11 at a time. In this case the use of two channels 10 may be advantageous because of wear.

In this case the discharge cycles in the event of rolling single sections or of splitting into two sections coincide inasmuch as, if one single section 11 arrives at a time, the discharge is performed after two arrival cycles, that is to say, when two sections 11 are present in the respective guide grooves 12.

The cycle shown in FIG. 4 for one or two sections 11 includes:

arrival of the first section la in the first channel 10*a* (or simultaneous arrival of the sections 1*a* and 1*b* in the event of splitting into two sections);

arrival of the second section 1*b* in the first channel 10*a;* discharge of the two sections 1*a* and 1*b* onto the cooling plate 18 and simultaneous arrival (separate or simultaneous) of the sections 2*a* and 2*b* in the second channel 10*b;* forward movement of the cooling plate 18 by two pitches;

discharge of the sections 2*a* and 2*b* from the second channel 10*b* and simultaneous arrival (separate or simultaneous) of new sections 3*a* and 3*b* in the first channel 10*a* and therefore repetition of the cycle.

The figure shows that with this solution two seatings 19 remain empty on the cooling plate 18 between the sections 1*a* and 1*b* of the first receiving and discharging cycle of the first channel 10*a* and the sections 3*a* and 3*b* of the second cycle and are filled by the sections discharged from the second channel 10*b*, thus ensuring excellent filling of the cooling plate 18.

FIG. 5 shows the case of splitting into three sections 11. In this case the receiving and discharging cycle includes:

arrival of three sections 1*a*, 1*b* and 1*c* in the first channel 10*a*, with the section 1*c* occupying the upper lefthand position in the channel 10*a;* discharge of the sections 1*a* and 1*b* positioned in the lower grooves of the channel 10*a* onto the cooling plate 18 and simultaneous arrival of the sections 2*a*, 2*b* and 2*c* in the second channel 10*b*, with the section 2*c* occupying in this case the upper righthand position in the channel 10*b;* two cycles of forward movement, each of two pitches, of the cooling plate 18;

discharge of the two sections 2*a* and 2*b* positioned in the lower grooves of the second channel 10*b* onto the cooling plate 18 and simultaneous arrival of the new sections 3*a*, 3*b* and 3*d*, with section 3*d* occupying the upper righthand position in the first channel 10*a* alongside the section 1*c* of the previous cycle of arrival;

forward movement of the cooling plate 18 by two pitches;

discharge of the two sections 3*a* and 3*b* and simultaneous arrival of the sections 4*a*, 4*b* and 4*d*, with section 4*d* occupying the upper lefthand position in the second channel 10*b;* forward movement of the cooling plate 18 by two pitches;

discharge of the sections 1*c* and 3*d* from the first channel 10*a;* forward movement of the cooling plate 18 by two pitches;

discharge of the sections 4*a* and 4*b* from the second channel 10*b* and simultaneous arrival of the sections 5*a*, 5*b* and 5*c* in the first channel 10*a;* forward movement of the cooling plate 18 by two pitches;

discharge of the sections 2*c* and 4*d* from the second channel 10*b;* forward movement of the cooling plate 18 by two pitches and successive discharge of the sections 5*a* and 5*b* from the first channel 10*a* and repetition of the cycle.

Lastly, FIG. 6 shows the cycle relating to the splitting into four sections, this cycle including:

simultaneous arrival of the sections 1*a*, 1*b*, 1*c* and 1*d* in the first channel 10*a;* discharge of the sections 1*a* and 1*b* positioned in the lower grooves of the first channel 10*a* onto the cooling plate 18;

forward movement of the cooling plate 18 by two pitches;

discharge of the sections 1*c* and 1*d* positioned in the upper grooves of the first channel 10*a* onto the cooling plate 18 and simultaneous arrival of the sections 2*a*, 2*b*, 2*c* and 2*d* at the same time in the second channel 10*b;* forward movement of the cooling plate 18 by two pitches;

discharge of the sections 2*a* and 2*b* positioned in the lower grooves of the second channel 10*b* onto the cooling plate 18;

forward movement of the cooling plate 18 by two pitches;

discharge of the sections 2*c* and 2*d* positioned in the upper grooves of the second channel 10*b* onto the cooling plate 18 and simultaneous arrival of the sections 3*a*, 3*b*, 3*c* and 3*d* at the same time in the first channel 10*a;* forward movement of the cooling plate 18 by two pitches;

discharge of the sections 3*a* and 3*b* positioned in the lower grooves of the first channel 10*a* onto the cooling plate 18 and repetition of the cycle.

We claim:

1. Method for the multiple receipt and discharge of rolled sections onto a cooling plate having a plurality of acceptance seatings for accepting sections, the seatings having a pitch "i", comprising delivering a first group of two or more rolled sections simultaneously from an intake channel to at least one multigroove equipped channel, the at least one multigroove channel comprising a supporting bar and panels moveable with respect to and provided adjacent opposite sidewalls of the supporting bar, the sidewalls having an upper portion extending further toward the panels than a lower portion of the sidewalls, each of the panels cooperating with one of the sidewalls of the supporting bar to define therebetween a first guide groove adjacent the lower portion of the sidewall and a second guide groove above the first guide groove and adjacent the upper portion of the sidewall, the panels and sidewalls being conformed to ensure that a first displacement of each panel away from the supporting bar frees a section in the first guide groove while a further displacement frees a section in the second guide groove, discharging the first group while another group of sections arrives in separate distinct grooves in the at least one multigroove equipped channel, such discharge taking place in cooperation with specific acceptance seatings on the cooling plate, advancing the cooling plate in each forward movement cycle by a number of acceptance seatings equal to "n" times the pitch ("i") of the cooling plate, the number "n" being a function of the number of rolled sections arriving at the same time, wherein adjacent lower grooves of said at least one multigroove equipped channel are separated by a distance approximately equal to the pitch "i" of the cooling plate, whereby discharge of sections from the adjacent lower grooves allows the sections to fall directly into adjacent acceptance seatings in the cooling plate.

2. Method as in claim 1, whereby the single sections of each group of sections are delivered into the channel in vertically arranged grooves.

3. Method as in claim 1, whereby the single sections of each group of sections are delivered into the channel in horizontally arranged grooves.

4. Method as in claim 1, whereby the number "n" equals 2.

5. Method as in claim 1, which includes at least two multigroove channels positioned side by side, one of which is suitable to receive a group of sections leaving a multisection rolling line at the same time, while the other channel discharges onto the cooling plate the group of sections received simultaneously in the preceding arrival cycle.

6. Method as in claim 5, whereby the two channels tend a rolling line that rolls one multiple section at a time.

7. Method as in claim 5, whereby the channels discharge two sections at a time.

8. Method as in claim 5, whereby the distance on the cooling plate between the single sections of a first arrival cycle discharged from a first channel and the sections of a second arrival cycle discharged from the same first channel comprises a number of seatings equal to the number of sections discharged, during normal running, from the other second channel per each discharge cycle.

9. Device to receive and discharge a multiple of rolled sections onto a cooling plate having a plurality of acceptance seatings for accepting rolled sections, the device being suitable to handle groups of a plurality of rolled sections at the same time, comprising a supporting bar positioned above the cooling plate and panels movable with respect to and provided adjacent opposite sidewalls of the supporting bar, the sidewalls having an upper portion extending further towards the panels than a lower portion of the sidewalls, wherein the panels and supporting bar define therebetween a first guide groove adjacent the lower portion of the sidewall and a second guide groove above the first guide groove and adjacent the upper portion of the sidewall on each side of the supporting bar, wherein each panel and adjacent sidewall are conformed to ensure that a first limited displacement of each panel away from the supporting bar frees a section in the first guide groove while a further displacement frees a section in the second guide groove.

10. Device as in claim 9, in which the movable panels are one in number per each side of the supporting bar and the perpendicular movement of the movable panels is associated with the movement of the cooling plate.

11. Device as in claim 9, in which the movable panels are two per side, one for the first guide groove and one for the second guide groove respectively.

12. Device as in claim 9, which includes two multigroove channels positioned side by side above the cooling plate.

13. Device as in claim 9, in which the width of the downward outlet from the multigroove channels for the sections positioned side by side on the same horizontal plane within the guide grooves is about equal to the pitch "i" of the seatings of the cooling plate.

14. Method for the multiple receipt and discharge of rolled sections onto a cooling plate having a plurality of acceptance seatings for accepting sections, the seatings having a pitch "i", comprising delivering a first group of two or more rolled sections simultaneously from an intake channel to a first multigroove equipped channel, the at least one multigroove channel comprising a supporting bar and panels moveable with respect to and provided adjacent opposite sidewalls of the supporting bar, the sidewalls having an upper portion extending further toward the panels than a lower portion of the sidewalls, each of the panels cooperating with one of the sidewalls of the supporting bar to define therebetween a first guide groove adjacent the lower portion of the sidewall and a second guide groove above the first guide groove and adjacent the upper portion of the sidewall, the panels and sidewalls being conformed to ensure that a first displacement of each panel away from the supporting bar frees a section in the first guide groove while a further displacement frees a section in the second guide groove, discharging the first group while another group of sections arrives in separate distinct grooves in a second multigroove equipped channel, corresponding grooves of the first and second multigroove equipped channels being separated by a number of acceptance seatings so as to achieve a complete filling of the seatings with normal working, such discharge taking place in cooperation with specific acceptance seatings on the cooling plate, advancing the cooling plate in each forward movement cycle by a number of acceptance seatings equal to "n" times the pitch ("i") of the cooling plate, the number "n" being a function of the number of rolled sections arriving at the same time.

* * * * *